United States Patent [19]

Dudley et al.

[11] Patent Number: 4,662,551

[45] Date of Patent: May 5, 1987

[54] BACK-PACK POWER SUPPLY FOR PNEUMATIC HAND TOOLS

[75] Inventors: Lynn A. Dudley, Chino; Boris B. Kamentser, Fountain Valley, both of Calif.

[73] Assignee: Corona Clipper Company, Corona, Calif.

[21] Appl. No.: 796,734

[22] Filed: Nov. 12, 1985

[51] Int. Cl.[4] ..... A45F 3/08

[52] U.S. Cl. ..... 224/211; 224/262; 224/907; 224/148

[58] Field of Search ..... 224/148, 261, 262, 263, 224/210, 211, 907; 221/185; 222/175

[56] References Cited

U.S. PATENT DOCUMENTS

| | | | |
|---|---|---|---|
| 2,958,155 | 11/1960 | Emmerich | 222/175 X |
| 3,199,785 | 8/1965 | Schmierer | 224/148 X |
| 3,223,172 | 12/1965 | Moss . | |
| 3,403,818 | 10/1968 | Enssle | 222/175 X |
| 3,945,571 | 3/1976 | Rash | 222/175 X |
| 3,987,869 | 10/1976 | Bowers | 222/175 X |
| 4,009,809 | 3/1977 | Morris | 224/261 |
| 4,145,028 | 3/1979 | Kelley et al. | 224/263 X |
| 4,189,075 | 2/1980 | Hall | 224/148 |
| 4,369,903 | 1/1983 | Wilkes | 224/211 X |

*Primary Examiner*—Stephen Marcus
*Assistant Examiner*—Robert M. Petrik
*Attorney, Agent, or Firm*—Georges A. Maxwell

[57] ABSTRACT

A unitary back-pack air supply to supply air to a pneumatic hand tool. The back-pack includes a substantially flat, rectilinear frame defining an air supply chamber and substantially flat vertical front and rear planes. Shoulder and waist straps are connected with the frame to extend over the shoulders and about the waist of a wearer and to support the frame at the wearer's back. A heat and sound insulating and vibration dampening back engaging panel is carried by the frame at the front plane thereof. A mounting plate is positioned rearward of the rear plane of the frame and is connected thereto by shock mounting devices. An engine driven air compressor unit is mounted on the plate to project rearwardly therefrom. An air supply line connects the unit with the chamber of the frame. An elongate flexible air delivery line connects with and extends between the frame and a pneumatic tool engaged in one hand of the wearer. The mounting plate and unit are spaced from said panel for the free flow of cooling air therebetween and in vibration insulated relationship.

8 Claims, 16 Drawing Figures

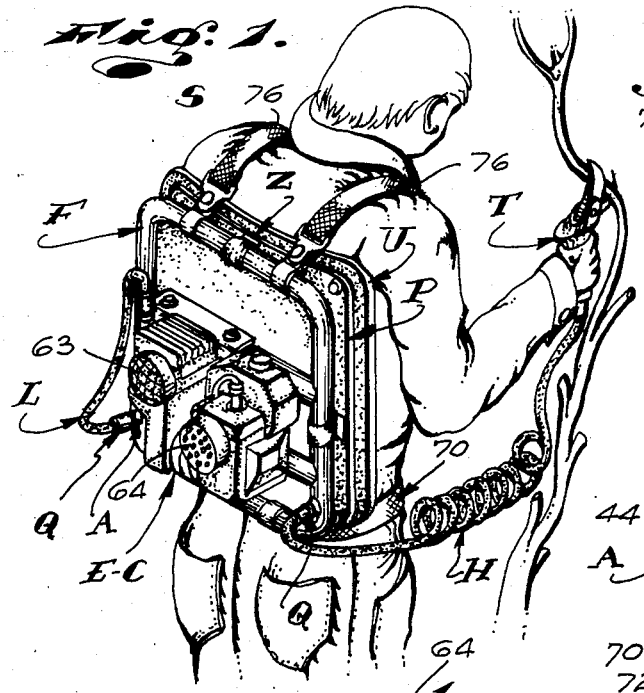
Fig. 1.
S
76
76
Z
F
T
U
P
63
L
70
64
Q
A
E-C
H
Q
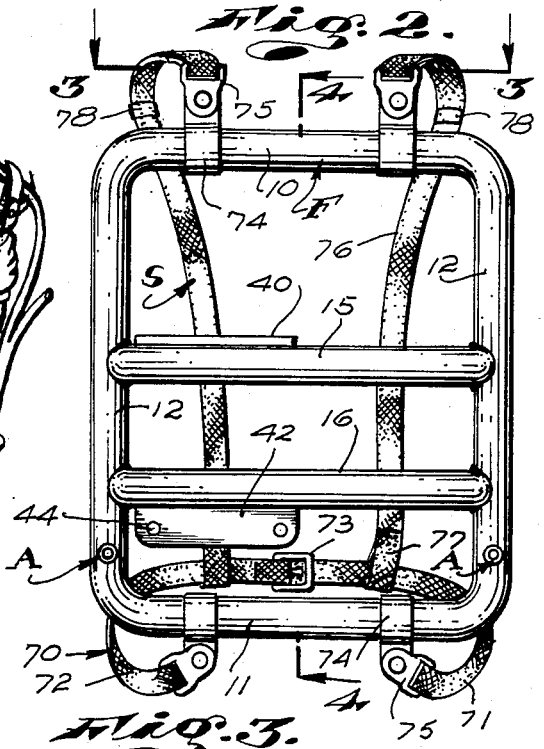
Fig. 2.
3
4
3
78
75
78
10
74
F
76
12
S
40
15
12
42
16
44
73
72
A
A
70
72
11
74
4
75
71
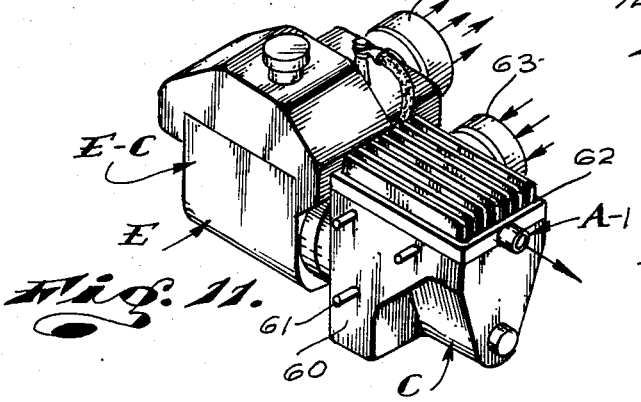
64
63
E-C
62
A-1
E
61
60
C
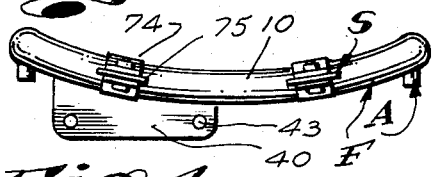
Fig. 3.
74
75
10
S
43
A
40
F
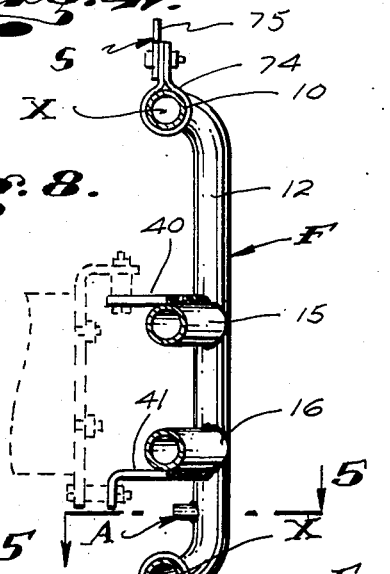
Fig. 4.
75
S
74
10
X
12
40
F
15
41
16
5
A
X
5
S
F
12
A
X
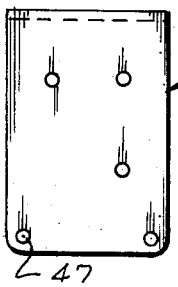
Fig. 6.
M
M
47
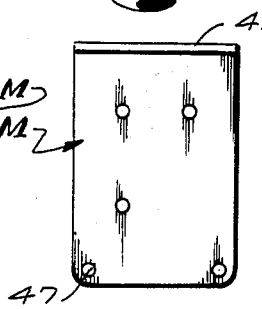
Fig. 7.
45
47
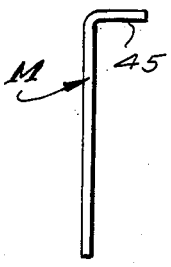
Fig. 8.
M
45
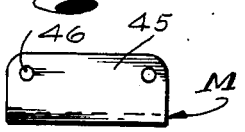
Fig. 9.
46
45
M
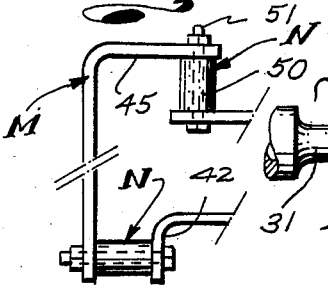
Fig. 10.
51
N
50
45
M
N
42
31
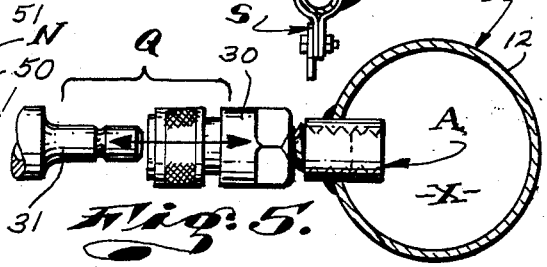
Q
30
A
X
Fig. 5.

BACK-PACK POWER SUPPLY FOR PNEUMATIC HAND TOOLS

This invention has to do with a portable back pack pneumatic power supply unit.

BACKGROUND OF THE INVENTION

Throughout the industrial arts, there is an ever-increasing provision and use of pneumatically powered hand tools. Such pneumatic tools include manually engageable rotary drive tools for fastener driving sockets; grinding and/or sanding wheels and the like; manually engageable axially driven impact tools for chisels, riveting tools and the like; and reciprocating drive tools for operating various work performing devices such as staplers, nailing machines and wire bending devices.

In addition to the above noted general types and classes of hand tools, there is an increasing number of specialized pneumatic hand tools. Included among these specialized tools are pneumatically powered, hand-actuated agricultural shears for trimming grape vines, fruit trees and the like. One such pneumatically powered, hand operated shears is the "Super Star" Model SF, manufactured by Campagnola in Bologna, Italy.

For the purpose of describing my invention, I will show and describe my back pack pneumatic power supply unit related to and supplying motive air to a manually operated pneumatically powered shears. It is to be understood that in practice, the power supply unit that I provide can be advantageously used to supply motive air to a multiplicity of other and different tools and devices without departing from the broader aspects and spirit of my invention.

In the prior art, where pneumatically powered hand tools are used, the use of such tools has been limited and/or restricted to relatively small and/or restricted areas within close proximity to and about common or conventional stationary high pressure air supplies consisting of large and heavy motor driven compressors and large, heavy air supply tanks. The range of use of such tools has, as a general rule, been limited to that length of flexible air supply hose that can be effectively, conveniently and safely used to connect the hand tools with their related stationary air supplies.

While the prior art provides air supply units which are sufficiently small and light so that they can be supported by means of wheels and manually moved about from one site to another, they are not "portable" in the sense that they can be physically carried about by the users thereof, when in operation and as the users thereof are carrying out the work that is to be performed.

As a result of the foregoing, we have recognized the great need for a small, compact, lightweight pneumatic power supply unit for pneumatically powered hand tools which can be advantageously supported on the backs of and carried by the users of pneumatically powered hand tools whereby the range of use of such tools is not limited by the length of air supply hoses that can be used and is not dependent upon continuously or intermittently transporting and moving a separate air supply means from one work site to another during normal and intended ongoing or continuous use of the hand tools.

OBJECTS AND FEATURES OF OUR INVENTION

It is an object of my invention to provide a novel back pack power supply unit including a small, compact, light-weight engine-compressor unit which includes an internal combustion engine and a related air compressor, a novel air accumulator frame structure on which the engine-compressor unit is mounted, strap means for supporting the frame on the back of a person, a flexible heat, sound and vibration dampening panel carried by the frame and engaging the back of the person and air delivery means including an elongate, flexible air delivery hose extending from the air accumulator frame to a pneumatic hand tool engaged in and operated by a hand of the person.

It is an object and a feature of our invention to provide a back pack unit of the general character referred to wherein the air accumulator frame is a substantially flat, vertical, rectangular frame that defines a high pressure air supply chamber which serves the function of and eliminates the need for a high pressure air supply tank such as is commonly included in and characterizes most air supply means used to supply air to pneumatic hand tools and the like.

Another object and feature of our invention is to provide an air accumulator frame of the general character referred to above having upper, lower, right and left hand portions accessible at the upper, lower, right and left hand portions of the back of a person with which the frame is related and having air fittings at each of said portions of the frame to releasably connect with an elongate flexible air supply hose extending from the frame to a pneumatic hand tool engaged in a hand of said person whereby the supply hose can be connected with any one of said portions of the frame to extend forwardly, vertically and laterally therefrom for most convenient and trouble free extension of the hose and so that the shortest possible length of hose is required.

Yet another object and feature of our invention is to provide a back pack unit of the general character referred to above wherein the engine-compressor unit is mounted on and carried by a mounting plate, which plate is connected with the frame, in spaced relationship therefrom by shock absorbing mounting means whereby said engine-compressor unit is supported in spaced relationship rearward from and in non-vibration and non-heat transmitting relationship therewith.

It is another object and feature of our invention to provide a back pack unit of the general character referred to above wherein the flexible heat, sound and vibration dampening panel is coextensive with and overlies the front of the frame; is fastened to the frame in forward spaced relationship from the mounting plate and the engine-compressor unit so that cooling air is free to circulate across the rear of the panel and about the engine-compressor unit and so that the spaced parts are in non-heat conducting relationship with each other.

It is another object and feature of our invention to provide a back pack unit of the general character referred to above wherein said panel includes a rear laminate of resilient flexible material having a low index of heat conductivity and a sound and heat reflecting rear surface and has a front laminate of soft, resilient, interconnected cellular foam or fibrous material that comfortably conforms to a person's back, through which air freely circulates, which has a low index of heat conductivity and which effectively dampens sound and vibration.

The foregoing and other objects and features of our invention will be apparent and fully understood from the following detailed description of a typical preferred form and embodiment of our invention, throughout which description reference is made to the accompanying drawing.

DESCRIPTION OF THE DRAWINGS

FIG. 1 is an isometric view of my invention engaged on the back of a user;

FIG. 2 is a back view of the accumulator frame with strap means related to it;

FIG. 3 is a view taken substantially as indicated by line 3—3 on FIG. 2;

FIG. 4 is a view taken substantially as indicated by line 4—4 on FIG. 2 with related parts shown in dotted lines;

FIG. 5 is an enlarged detailed sectional view of an air fitting taken substantially as indicated by line 5—5 on FIG. 4 and showing a quick disconnect fitting related to it;

FIGS. 6, 7, 8 and 9 are rear, front, side and top views of the mounting plate;

FIG. 10 is an enlarged view showing related portions of the frame and mounting plate coupled with shock absorbing coupling devices;

FIG. 11 is an isometric view of the engine-pump unit;

DETAILED DESCRIPTION OF THE INVENTION

Figure 12:
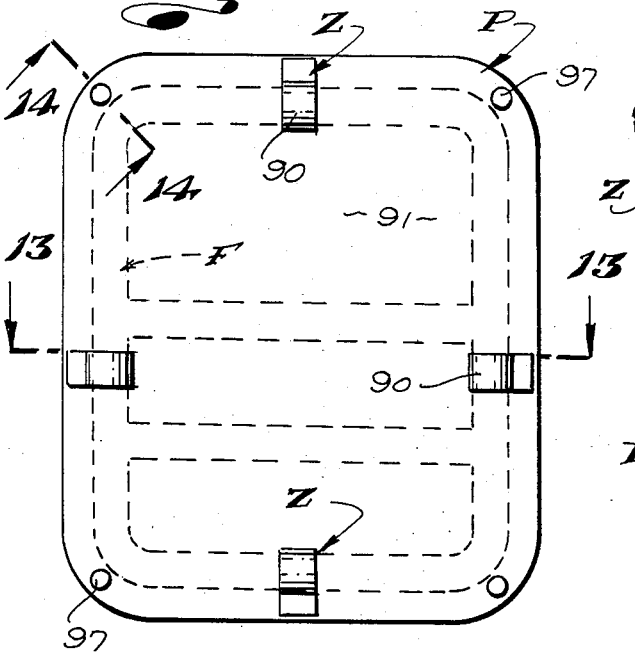
FIG. 12 is a back view of the panel.
Figure 13:
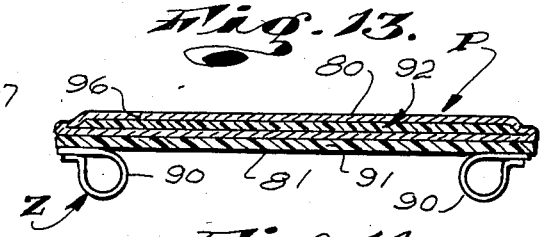
FIG. 13 is a view taken substantially as indicated by line 13—13 on FIG. 12.
Figure 14:
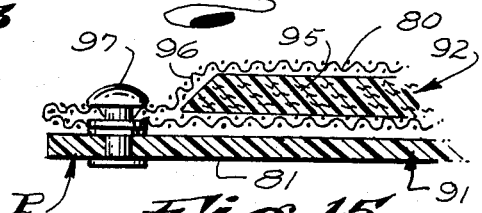
FIG. 14 is an enlarged detailed sectional view taken substantially as indicated by line 14—14 on FIG. 12.
Figure 15:
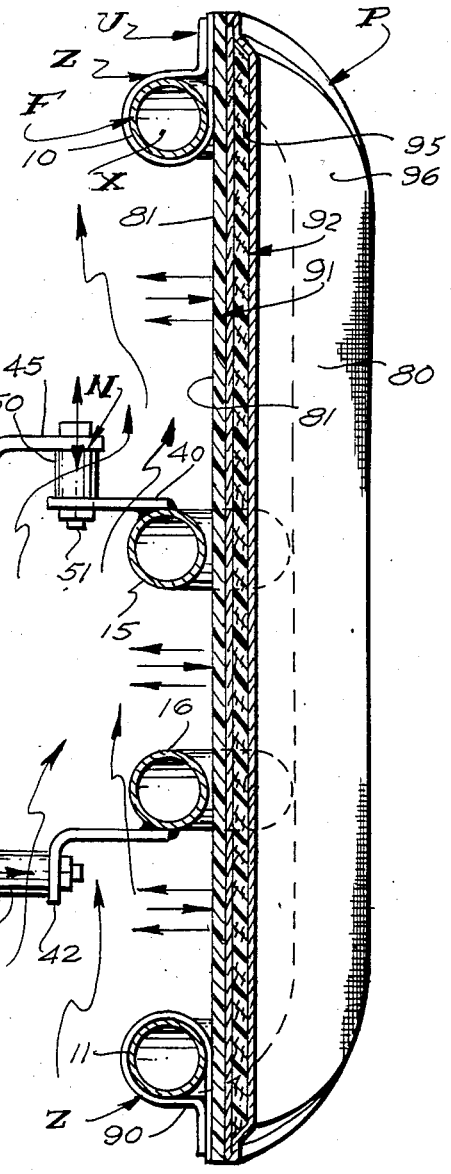
FIG. 15 is an enlarged vertical sectional view showing the frame, mounting plate, coupling units, engine-pump unit and panel in assembled relationship.

In FIG. 1 of the drawings we have shown my new back pack pneumatic power supply unit U (back pack unit) related to the back of a person. The person has a pneumatic hand tool T engaged in the hand of his forwardly extending right arm. The hand tool T is a pneumatic shears and is connected with the back pack unit U by an elongate flexible air supply hose H. The hose H can, as shown, have a spring reinforced helically wound central portion which makes the hose most convenient and safe to use.

The tool or shears T is shown as that type and/or class of shears identified above and which is manufactured for orchard pruning by Campagnola in Italy.

It is to be particularly noted and understood that the tool T is but one kind of pneumatic tool that can be advantageously powered or supplied with air by my new back pack unit U.

The back pack unit U is a fabricated structure and includes an air accumulator frame F, a mounting plate M coupled with and carried by the frame F, an engine compressor unit E-C carried by the mounting plate, a back engaging panel P carried by the frame and strap means S to hang and releasably secure the unit U in supported engagement on the back of a person or user. In addition to the foregoing, the back pack unit U includes air conducting fittings A on the frame, an air fitting A-1 on the compressor C of the unit E-C, an air delivery line L connected with and between the fitting A-1 and a related fitting A, an elongate flexible delivery hose H connected with a related fitting A and extending to and connected with an inlet fitting A-2 on the tool T and shock mounting means N to couple the the plate M to the frame F.

Other means and details of the back pack structure will be described in detail in the following.

The air accumulator frame F is a flat, substantially rectilinear, normally vertically extending structure with spaced forwardly and rearwardly disposed front and rear planes, vertically extending laterally spaced opposite sides and horizontally extending vertically spaced top and bottom ends. The lateral and vertical dimensions of the frame F are preferably slightly less than the lateral and vertical extent or dimensions of the back of the user's upper torso, hereinafter referred to as the user's back.

In practice, the frame F can be laterally straight or flat or can, as shown, be curved laterally so as to better conform to the shape of the user's back and to thereby impart the unit with greater lateral stability.

In the form of our invention illustrated in the drawings, the horizontal top and bottom ends and the vertical sides of the frame F are defined by elongate, large diameter, thin-walled tubing sections or portions 10, 11 and 12. The related ends of the portions 10, 11 and 12 are joined by four radiused corner sections or portions 14. In addition to the foregoing, the frame F includes vertically spaced upper and lower horizontal, transversely extending rails 15 and 16. The rails 15 and 16 are fixed to and extend between the opposite side portions 12 of the frame. The rails 15 and 16 can be and are shown as being established of tube stock and as being related to the side portions 12 with their interiors communicating with the interior of at least one of the side portions of the frame. The several sections and/or portions of the frame and the rails 15 and 16, which are in fact parts of the frame, cooperate to define a high pressure air accumulator chamber X. The chamber X extends about the outer perimeter portion of the frame structure and transverse thereof, within the rails.

By selection and use of tube stock of appropriate diameter when establishing the frame F, the volume of the chamber X can be made to satisfy the desired and/or recommended volume of supply air for satisfactory operation of the tool T, based upon the output capacity of the compressor C.

It is important to note that the air accumulator frame F is such that it can be made little or no heavier than many common pack frames and considerably lighter than the combined weight of a common back pack frame and a common or ordinary high pressure air supply tank of equal volume.

Further, it is important to note that while the frame F is slightly more bulky than a common or ordinary back pack frame, it is materially smaller and less bulky than the combined bulk of a common back pack frame and a common air supply tank of equal volume. Still further, it is important to note that the frame F affords ready access to the supply of air therein about the entire perimeter of the frame and eliminates any need for costly, complicated and heavy manifolding or the like that might be otherwise be required to conduct air, from a separate tank, to any one side or end of the frame.

In addition to the foregoing, the frame F includes the above referred to air conducting fittings A. The number and location of the fittings A can be varied as desired and as circumstances require. The basic frame structure includes at least two fittings A, one to conduct air from the compressor C (through the line L) into the chamber X and another to conduct air from the chamber X (through the hose H) to the tool T. In FIGS. 1 through 5 of the drawings, we have shown the frame X provided with two fittings A, there being one fitting at and projecting rearwardly from the lower end of each side portion 12 of the frame.

The fittings A can vary in details of construction and are shown as simple, internally threaded nipples of suitable length engaged through openings in and sealingly welded to the frame, as clearly shown in FIG. 5 of the drawings.

In practice, the line L, hose H and any other device or means that is to be connected with the fittings A can be provided with threaded air conducting male fittings which can be or are threadedly engaged in related fittings A.

In the preferred carrying out of our invention, we provide quick disconnect air coupling units Q at and between the fittings A and the elements or parts of the structure which are related to the fittings A. As shown in FIG. 5 of the drawings, the units Q include female receiver parts 30 engaged in the fittings A and male connector parts 31 releasably engaged in the female parts 30 and suitably connected with and carried by the line L, hose H and other devices and/or means which are or might be connected with and receive air from the frame F.

Figure 16:
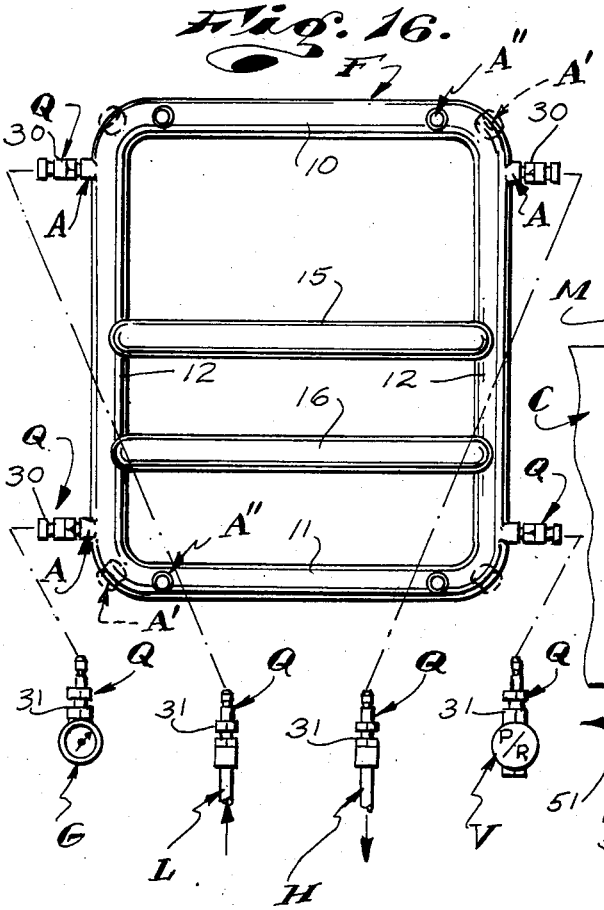

In one preferred carrying out of the invention and as illustrated in FIG. 16 of the drawings, the frame can be provided with fittings A at each corner portion of the frame F. Further, if desired and as shown in FIG. 16 of the drawings, the several fittings can be at the upper and lower ends of the side portions 12 of the frame and project laterally outwardly therefor, as shown in dotted lines at A'; can be at the radiused corner portions of the frame and project diagonally outwardly and rearwardly therefrom or, as shown in dotted lines at A", can be at the opposite ends of the top and bottom portions 10 and 11 of the frame and disposed to project rearwardly therefrom. Further, if desired, the subject fittings might be located at the centers of the top, bottom and side portions of the frame and project in any desired direction therefrom, as desired or as circumstances require.

With a multiplicity of fittings A arranged about the frame in any one of the above noted manners and with quick disconnect coupling part 30 related to them, easy and quick rearrangement of the delivery hose H so that it extends from the upper, lower, right or left-hand portions of the frame is made possible. By suitably arranging the hose H relative to the frame F, it can be made to most effectively and conveniently extend forwardly, laterally and vertically to the (right or left) hand of the user in which the tool T is engaged. Such rearranging of the hose H relative to the frame might, in many instances, be very important since it enables the structure to be adjusted for most effective and efficient use by both right and left-hand users and for performing low and overhead work where the user's arm with which the tool T is related is most often extended substantially downwardly or is most often extended substantially upwardly.

It will be apparent that when the arrangement and connection of the hose H is changed from one fitting A to another, it is or might be necessary that connection of the line L be changed from one to another of said fittings A. With the quick disconnect couplings Q, such rearranging and connecting of parts can be quickly and easily effected.

Referring to FIG. 16 of the drawings, in addition to the hose H and line L (each of which has a coupling part 30), we have shown a pressure gauge G and a pressure relief valve V (each with a coupling part 31). The gauge G and valve V are to be engaged with the two fittings A which are not connected with the hose H and line L. With the gauge G and the valve V, each of which serves a desired and useful purpose, together with the hose H and line L, all four fittings A in the frame illustrated are put to useful end. The arrangement of the hose H, line L, valve V and gauge G about the perimeter portion of the frame can be varied as desired and as circumstances require.

In addition to the foregoing, the frame F is provided with and includes upper and lower mounting brackets 40 and 41 for the mounting plate M. The upper bracket 40 is an elongate horizontal laterally extending plate fixed (welded) to and projecting rearwardly from the upper rail 15 of the frame. The lower bracket 41 is similar to the bracket 40, is fixed to and projects rearwardly from the lower rail 16 and further includes a flat, vertical flange 42 at and along its rear edge. The upper bracket 40 has a pair of laterally spaced vertical apertures 43 and the flange 42 on the lower bracket 41 has a pair of laterally spaced apertures 44.

In the case illustrated, the longitudinal extent of the mounting brackets are about one-half the lateral extent of the frame and are positioned at the lower left quarter portion of the frame.

The mounting plate M, as shown in FIGS. 6 through 10 and 15 of the drawings, is a flat, vertical, substantially rectangular metal plate with flat front and rear surfaces, substantially equal in lateral extent with the lateral extent of the mounting brackets and substantially greater in vertical extent than the vertical distance between the brackets 40 and 41. The plate M is positioned in rearward spaced relationship from the brackets 40 and 41 and has a flat, horizontal, laterally extending, forwardly projecting top flange 45 that overlies the top bracket 40 in vertical spaced relationship and which is provided with a pair of apertures 46 which is aligned with the apertures 44. The lower end of the plate M is spaced rearward from the flange 42 of the bracket 41 and has a pair of apertures 47 which are aligned with the apertures 44 in the flange 42 of the bracket 41.

Finally, the mounting plate is provided with a set of fastener apertures 47 arranged to receive mounting studs (or equivalent fastener means) on the compressor C of the engine-compressor unit E-C.

The plate M is coupled to the brackets 40 and 41 by the aforementioned shock mounting means N. The shock mounting means N include four shock units U. The shock units U can be any one of a considerable number of commercially available shock mounting units which are most commonly characterized by elongate resilient (rubber or spring) body portions 50 with opposite ends to engage flat spaced opposing surfaces of pairs of parts to be coupled and which have threaded mounting studs 51 (or equivalent fastener parts) at their opposite ends to engage through and to be secured to the parts to be coupled. In the case illustrated, a pair of laterally spaced vertically extending units U are engaged between the upper flange 45 of the plate M and the upper mounting bracket 40 and with their studs engaged through the related pairs of registering apertures 46 and 44. A second pair of laterally spaced, horizontally extending units U are engaged between the lower end of the plate M and the lower flange 42 of the bracket 41 with the studs thereof engaged through related pairs of apertures 47 and 44. The several units are made fast to the plate M and the related brackets 40 and 41 by nuts engaged on the studs, substantially as shown.

It is to be particularly noted that while it is important that the mounting plate M be "shock mounted" on the frame F, the particular structure employed to attain such an end can be varied greatly and the structure that we have illustrated and described above is but one preferred structure that attains that end.

The engine-compressor unit E-C shown in FIGS. 1 and 11 of the drawings is illustrative of an engine and compressor unit that we have employed in our reduction to practice of the invention.

The unit E-C includes a two cycle gasoline fueled internal combustion engine E and a compressor unit C. The compressor unit C has a crank case with a flat, vertical, forwardly disposed mounting surface 60 from which a set of three mounting studs 61 project. The compressor C has a head 62 atop the crank case. The head 62 has an air outlet port in which an air outlet fitting A-1 is engaged. The fitting A-1 is suitably coupled with the inlet end of the elongate flexible air line L. The compressor head also has an air inlet port (not shown) with which an air inlet filter unit 63 is engaged.

The engine E of the unit E-C is suitably coupled with and carried by the compressor C, substantially as shown. The engine E is shown equipped with a rearwardly disposed canister type exhaust muffler 64 at its rear side.

The particular unit E-C that we have used weighs less than 10 lbs. and has an effective output of 1.6 CFM at about 100 psi.

We have determined that there are several different sizes, makes and models of engines and compressors that can or might be advantageously used in practicing our invention. To adopt and use those other engines and/or compressors, the size, shape and/or location of the mounting plate M relative to the frame F and the form of the means provided to mount the engine and/or compressor to the mounting plate would have to be modified. Accordingly, in accordance with the broader aspects and spirit of our invention, the engine-compressor unit E-C that we have shown is to be viewed as merely illustrative of one engine and compressor sub-assembly or unit that can be used and that the particular manner in which the unit E-C is arranged and mounted relative to the frame F might have to be altered to accommodate other and different engine and compressor sub-assemblies or units.

The strap means S provided to hang and releasably secure the back pack unit U adjacent the back of the user includes a lower sectional belt-like waist strap 70 comprising elongate, flexible right and left-hand sections 71 and 72 with rear ends coupled to opposite end portions of the lower portion 11 of the frame F. The sections 71 and 72 extend laterally outwardly forwardly and thence laterally inwardly relative to the frame and have front end portions adjustably connected together by a central forward buckle 73. The rear ends of the sections 71 and 72 are coupled to the horizontal laterally extending lower tube portion 11 of the frame F by screw operated clamp bands 74 engaged about the frame portion 11. The clamp bands 74 include slotted coupler plates 75 through which loops formed at the rear ends of the sections 71 and 72 are engaged, substantially as shown in FIG. 2 of the drawings. The plates 75 are pivotally carried by the bands.

The strap means S next includes elongate flexible left and right hand shoulder straps 76 with upper rear ends connected to related left and right hand ends of the horizontal laterally extending upper tube portion 10 of the frame 11 by screw operated clamp bands 74 with related coupler plates 75 which are similar to the clamp band and plate assemblies provided to couple the rear ends of the sections 71 and 72 of the waist strap to the frame. The shoulder straps 76 extend upwardly, forwardly and downwardly relative to the top of the frame F and have loops 77 at their lower ends through which related sections 71 and 72 of the waist strap 70 are engaged.

The upper end portions of the shoulder straps 76 are engaged through the slots in their related coupler plates 75 and are turned forwardly to engage with buckles 78 to allow for adjustment of the effective length of the straps.

In use, the frame F of the unit U is positioned rearward of and adjacent the back of the user, the waist strap 70 is engaged about the user's waist and the shoulder straps 76 are engaged over the shoulders of the user. Thus, the strap means S effectively hangs the unit U from the user's shoulders adjacent the user's back. By adjusting the effective length of the waist and shoulder straps and the lateral positioning of the clamp bands 74 on the frame, the strap means S can be adjusted to comfortably and effectively mount the unit U on the back of any person who is physically equipped and capable of carrying and using the unit U.

The back engaging panel P is a flat, vertical, rectangular unit with front and rear surfaces 80 and 81. The panel P is preferably slightly greater in lateral and vertical extent than the frame and is positioned adjacent the front plane of the frame, as clearly shown in FIGS. 1 and 15 of the drawings. The panel P is a resilient, flexible structure which, as a unit, is capable of yieldingly bending and flexing to conform to the wearer's back. The panel P is releasably secured to the frame F by tie means Z which can be in the form of simple, flexible straps or cords fixed to the panel and engaged about the sides and end portions of the frame and tied or can, as shown, be in the form of flexible straps 90 fixed to and carried by the panel and engaged about related tubular portions of the frame and provided with Velcro fastener patches, or equivalent snap fastener devices to releasably hold them engaged about said related tubular portions of the frame.

In the case illustrated, we have shown the panels provided with four straps 90, there being one strap at the central portion of each side and end of the panel. It will be apparent that the number and location of the straps 90 can be varied as desired or as circumstances require.

In the preferred carrying out of our invention, the panel P is a laminated structure and includes a rear, dimensionally stable, resilient and flexible rear laminate 91 defining the rear surface 81 of the panel and a soft, resilient back engaging front laminate 92 carried by and overlying the rear laminate and defining the front surface 80 of the panel. The rear laminate can be and is preferably established of a dense plastic or composite plastic and fibrous material, the rear surface 81 of which is smooth, whereby it is effective to reflect (rearwardly) both heat and sound.

The soft, resilient front laminate 92 is in the nature of a soft, resilient pad which conforms to the wearer's back and which is sufficiently porous to allow for the free flow and/or circulation of air between the wearer's back and the rear laminate 91. The laminate 92 is preferably made of a material having a low coefficient of heat conductivity and which is sufficiently dimensionally and structurally unstable so that it effectively dampens both sound and mechanical forces directed onto and through it.

In the preferred form and carrying out of our invention, the laminate 92 is established of a relatively thick sheet 95 of non-interconnected cellular plastic material or a sheet of garnetted fibrous material contained within a soft, flexible woven fabric envelope 96. For purposes of this disclosure, the envelope 96 of the laminate 92 is shown releasably secured to the rear laminate 91 by snap fastener devices 97 with related parts spaced about and secured to the edge portions of the envelope 96 and the laminate 91.

It will be apparent from the foregoing that the panel P occurs between the frame F and the user's back and, in addition to conforming to the wearer's back and affording desired comfort, it serves to dampen vibrations and sound between the user's back and the remainder of the back pack unit structure, serves as a thermal barrier and allows for substantial free circulation of air at the back of the wearer.

It is important to note that with the structure that we provide, the frame F is an open framework; the mounting plate M is shock mounted to the frame F in rearward spaced relationship from the panel P and frame F and that the engine-compressor unit E-C is carried by the mounting plate in rearward spaced relationship from the panel P and the frame F. With the above noted relationship of parts, our back pack unit U specifically and uniquely provides for the free circulation of cooling air between the assembly established by the mounting plate and the engine-compressor unit and the sub-assembly established by the frame and panel. The foregoing unique relationship of parts also allows for the substantial free rearward reflection and/or deflection of sound and heat from the rear surface 81 of the panel P and for the free dissipation of heat and sound laterally, vertically and rearwardly from the unit, rearward of the panel P.

Of equal importance, that structure and/or relationship of parts which provides for the free circulation of air forward of the engine-compressor unit E-C and its related mounting plate M allows for and induces the flow of cooling air about the unit E-C which is necessary, if not critical, for the satisfactory operation of the unit E-C. In this respect, the mounting plate M which is fixed directly to the unit E-C and is exposed to the free moving air forward thereof serves to absorb and conduct heat away from the unit E-C and to radiate and transfer that heat into the air moving across it. Thus, the mounting plate M in the structure that we provide, due to its relationship with other parts of the structure, is an effective heat dissipating part.

From the foregoing, it will be apparent that the back pack pneumatic power supply unit U that we have invented is a small, compact, lightweight unit that can be comfortably carried on the back of a user for protracted periods of time and which enables the user to effectively operate a manually operable pneumatic hand tool supplied with air by said unit U, independent of a separate and remote air supply.

Having described only typical preferred form and embodiment of our invention, we do not wish to be limited to the specific details herein set forth but wish to reserve to ourselves any modifications and/or variations that might appear to those skilled in the art and which fall within the scope of the following claims.

Having described my invention, I claim:

1. A back pack air supply unit for pneumatic hand tools commprising a flat, vertical hollow metal frame with front and rear planes respectively disposed forwardly and rearwardly relative to said frame, vertically spaced horizontally extending top and bottom ends and laterally spaced vertically extending sides, said frame defines a high pressure air chamber, mounting brackets fixed to the frame and projecting rearwardly from the rear plane thereof, a mounting plate spaced rearward from the frame and the mounting brackets, shock absorbing coupling devices fixed to and extending between the mounting brackets and the mounting plate, an internal combustion engine and air compressor unit mounted on the mounting plate and projecting rearwardly therefrom, at least two air conducting fittings on the frame communicating with the chamber and accessible at the exterior of the frame, an elongate, air conducting line with inlet and outlet ends, connecting means connecting the inlet end of the line with an outlet port of the compressor, a first coupling means coupling the outlet end of the line with one of the air conducting fittings, an elongate, air supply hose with inlet and outlet ends, a secondary coupling means connecting the inlet end of the hose to the other air conducting fitting, a manually operable pneumatic hand tool with an air inlet connected with the outlet end of the hose, a normally flat, vertical back engaging panel with forwardly and rearwardly disposed front and rear surfaces and positioned with its rear surface adjacent and opposing the frame and spaced forward from the mounting plate in heat insulated relationship thereto and defining an air conducting passage between the mounting plate, and the frame and back engaging panel; and strap means to releasably mount the unit on the back of a user with the front surface of the panel opposing and engaging the user's back, said strap means includes an elongate, flexible, horizontal waist strap connected with and projecting forward from the lower portion of the frame and engageable about the waist of the user and a pair of laterally spaced vertically extending shoulder straps connected with and projecting forwardly from the upper portion of the frame and engageable over the shoulders of the wearer.

2. The back pack air supply unit set forth in claim 1 wherein the frame is made of metal tubing and includes substantially horizontal, laterally extending top and bottom tubular portions and substantially vertically extending side tubular portions defining the perimeter of the frame and a central opening therethrough and having related ends communicating with each other to define said chamber.

3. The back pack air supply unit set forth in claim 1 wherein the frame is made of metal tubing and includes substantialy horizontal, laterally extending top and bottom tubular portions and substantially vertically extending side tubular portions defining the perimeter of the frame and a central opening therethrough and having related ends communicating with each other to define said chamber, said panel has perimeter portions engaging and releasably fastened to the tubular portions of the frame and a central portion overlying the central opening through the frame.

4. The back pack air supply unit set forth in claim 1 wherein the frame is made of metal tubing and includes substantially horizontal, laterally extending top and bottom tubular portions and substantially vertically extending side tubular portions defining the perimeter of the frame and a central opening therethrough and having related ends communicating with each other to define said chamber, said air conducting fittings are spaced apart and are accessible at spaced apart outer perimeter portions of the frame, said first and second coupling means include like primary quick disconnect coupling parts connected with the air conducting fittings and like secondary quick disconnect coupling parts connected with the line and the hose and selectively releasably engageable in the primary quick disconnect coupling parts.

5. The back pack air supply unit set forth in claim 1 wherein the frame is made of metal tubing and includes horizontal, laterally extending top and bottom tubular portions and vertically extending side tubular portions defining the perimeter of the frame and a central opening therethrough and having related ends communicating with each other to define said chamber, one of said air conducting fittings are spaced apart and are accessible at spaced apart outer perimeter portions of the frame, said first and second coupling means include like primary quick disconnect coupling parts connected with the air conducting fittings and like secondary quick disconnect coupling parts connected with the line and the hose and selectively releasably engageable in the primary quick disconnect coupling parts, said panel has perimeter portions engaging and releasably fastened to the tubular portions of the frame and a central portion overlying the central opening through the frame.

6. The back pack air supply unit set forth in claim 1 wherein one of said air conducting fittings is accessible at one side of the frame and the other air conducting fitting is accessible at the other side of the frame, said first and second coupling means include like primary quick disconnect coupling parts connected with the air conducting fittings and like secondary quick disconnect coupling parts connected with the line and the hose and selectively releasably engageable in the primary quick disconnect coupling parts.

7. The back pack air supply unit set forth in claim 1 wherein the frame is made of metal tubing and includes substantially horizontal, laterally extending top and bottom tubular portions and substantially vertically extending side tubular portions defining the perimeter of the frame and a central opening therethrough and having related ends communicating with each other to define said chamber, said frame further includes at least one rail extending across the opening thereof and carrying a mounting bracket for the mounting plate.

8. The back pack air supply unit set forth in claim 1 wherein the frame is made of metal tubing and includes substantially horizontal, laterally extending top and bottom tubular portions and substantially vertically extending side tubular portions defining the perimeter of the frame and a central opening therethrough and having related ends communicating with each other to define said chamber, said frame further includes at least one rail extending across the opening thereof and carrying a mounting bracket for the mounting plate, said rail is a tubular part with ends fixed to and communicating with the interior of its related tubular portions of the frame and defines a portion of the chamber.

* * * * *